US009788659B1

(12) United States Patent
Jen

(10) Patent No.: US 9,788,659 B1
(45) Date of Patent: Oct. 17, 2017

(54) SEAT FOR HIP SHAKING

(71) Applicant: TECVIEW GROUP CO., LTD., Taoyuan (TW)

(72) Inventor: Li-Wen Jen, Taoyuan (TW)

(73) Assignee: Tecview Group Co., Ltd., Taoyuan (TW)

( * ) Notice: Subject to any disclaimer, the term of this patent is extended or adjusted under 35 U.S.C. 154(b) by 14 days.

(21) Appl. No.: 15/136,099

(22) Filed: Apr. 22, 2016

(51) Int. Cl.

| | |
|---|---|
| ***A63B 21/00*** | (2006.01) |
| ***A47C 9/00*** | (2006.01) |
| ***A47C 7/02*** | (2006.01) |
| ***A63B 26/00*** | (2006.01) |
| ***A63B 23/02*** | (2006.01) |

(52) U.S. Cl.
CPC ..... *A47C 9/002* (2013.01); *A47C 7/021* (2013.01); *A63B 23/02* (2013.01); *A63B 26/003* (2013.01)

(58) Field of Classification Search
USPC ..... 482/1–48
See application file for complete search history.

(56) References Cited

U.S. PATENT DOCUMENTS 478,166 A * 7/1892 Madsen ..... A63B 23/08 482/146
3,863,982 A * 2/1975 Sandham ..... A47C 3/026 248/596
4,191,371 A * 3/1980 Armer, Jr. ..... A63B 21/0004 482/146
4,285,516 A * 8/1981 Heatwole ..... A63B 21/0004 482/146
5,603,334 A * 2/1997 Sharp ..... A61B 5/103 482/146
5,897,474 A * 4/1999 Romero ..... A63B 22/14 446/396
6,428,451 B1 * 8/2002 Hall ..... A63B 22/18 482/146
6,481,795 B1 * 11/2002 Pettibon ..... A47C 3/02 297/195.11
6,616,456 B1 * 9/2003 Nalty ..... A63B 26/003 434/247
6,666,802 B1 * 12/2003 Rasmussen ..... A63B 21/0608 482/140
6,709,052 B2 * 3/2004 Jalkanen ..... A47C 7/022 297/195.1
6,835,141 B2 * 12/2004 Eaves ..... A61H 1/001 297/181
6,872,175 B2 * 3/2005 Lin ..... A63B 21/0004 482/121

(Continued)

*Primary Examiner* — Stephen R Crow
(74) *Attorney, Agent, or Firm* — Muncy, Geissler, Olds & Lowe, P.C.

(57) ABSTRACT

A seat for hip shaking is set on a surface of a chair while in use. The seat for hip shaking includes a seat member and a base member arranged under the seat member. A top surface of the seat member is disposed with a saddle-shaped seat surface for users to sit thereon while a spherical surface is projecting downward from a bottom surface of the seat member. The base member has at least one support part on a top surface thereof. The spherical surface of the seat member is moveably supported by the support part of the base member and is rotated at an arbitrary angle. When a user sits on the saddle-shaped seat surface, he/she shakes the hip or maintains the balance to get the benefits of exercise like horse riding.

12 Claims, 9 Drawing Sheets

(56) References Cited

U.S. PATENT DOCUMENTS 7,008,360 B1 * 3/2006 Smith ..... A63B 26/003 482/146
7,081,075 B2 * 7/2006 Sachs ..... A63B 69/0093 482/146
7,090,628 B2 * 8/2006 Badarneh ..... A63B 22/16 482/140
7,175,577 B2 * 2/2007 Greenspan ..... A61H 1/0237 482/146
7,347,806 B2 * 3/2008 Nakano ..... A63B 69/04 434/247
7,374,517 B2 * 5/2008 Lockett ..... A63B 21/0004 297/271.5
7,476,188 B2 * 1/2009 Perez, Jr. ..... A63B 23/0211 472/103
7,566,291 B2 * 7/2009 Lickle ..... A63B 69/0093 482/146
7,632,218 B2 * 12/2009 Sannes ..... A63B 22/18 482/146
7,931,565 B2 * 4/2011 Nakano ..... A63B 24/00 434/247
8,092,356 B2 * 1/2012 Seel ..... A63B 22/18 482/146
8,435,164 B2 * 5/2013 VanBuren ..... A63B 26/003 482/145
8,998,319 B2 * 4/2015 Bahneman ..... A47C 9/00 297/195.11
9,474,929 B2 * 10/2016 Wu ..... A63B 55/53
2005/0029842 A1 * 2/2005 Martin ..... B62J 1/02 297/199
2007/0138850 A1 * 6/2007 Oettinger ..... A47C 3/029 297/271.5
2007/0298395 A1 * 12/2007 Nakanishi ..... A63B 69/04 434/258
2007/0298947 A1 * 12/2007 Eksteen ..... A63B 21/0004 482/141
2008/0009395 A1 * 1/2008 Tseng ..... A63B 69/04 482/51
2008/0207410 A1 * 8/2008 Tacconi ..... A63B 22/18 482/123
2009/0062090 A1 * 3/2009 Nakanishi ..... A63B 26/003 482/136
2009/0098520 A1 * 4/2009 Wilson ..... A63B 69/04 434/258
2009/0239718 A1 * 9/2009 Yamazaki ..... A63B 21/00181 482/57
2011/0028290 A1 * 2/2011 Ozawa ..... A63B 21/0085 482/142
2011/0105962 A1 * 5/2011 Ochi ..... A61B 5/0488 601/5

* cited by examiner

SEAT FOR HIP SHAKING

BACKGROUND OF THE INVENTION

The present invention relates to a seat for hip shaking, especially to a seat by which users can shake their hips or maintain their balance while the seat is set on a surface of a chair.

Body vibration machines such as hip shaking device allowing users to sit thereon for sports and fitness are available on the market now due to greater attention to the health. The user sits on the hip shaking machine, does the wiggle motion by the hip, or maintains his/her posture for fitness. Yet the conventional body vibration machine has certain limitations in the design. For example, the user can't move toward the direction he/she needs smoothly and easily. The vibration direction/angle has been set in advance. The device is less efficient.

Thus there is room for improvement and a need to provide a novel device for solving the problems mentioned above.

SUMMARY OF THE INVENTION

Therefore it is a primary object of the present invention to provide a seat for hip shaking by which users can shake or rotate their hips in an arbitrary direction. The seat for hip shaking is set on a surface of a chair while in use.

In order to achieve the above object, a seat for hip shaking of the present invention includes a seat member and a base member. The seat for hip shaking is set on a surface of a chair while in use. A top surface of the seat member is disposed with a saddle-shaped seat surface for users to sit thereon while a spherical surface is projecting downward from a bottom surface opposite to the saddle-shaped seat surface. The base member is arranged under the seat member and including at least one support part on a top surface thereof. The spherical surface of the seat member is moveably supported by the support part of the base member. While in use, the user sits on the saddle-shaped seat surface of the seat member and the seat member is moved into an arbitrary direction or rotated at an arbitrary angle relative to the base member by the user. Thereby the user shakes the hip or maintains the posture to get the benefits of exercise like horse riding.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
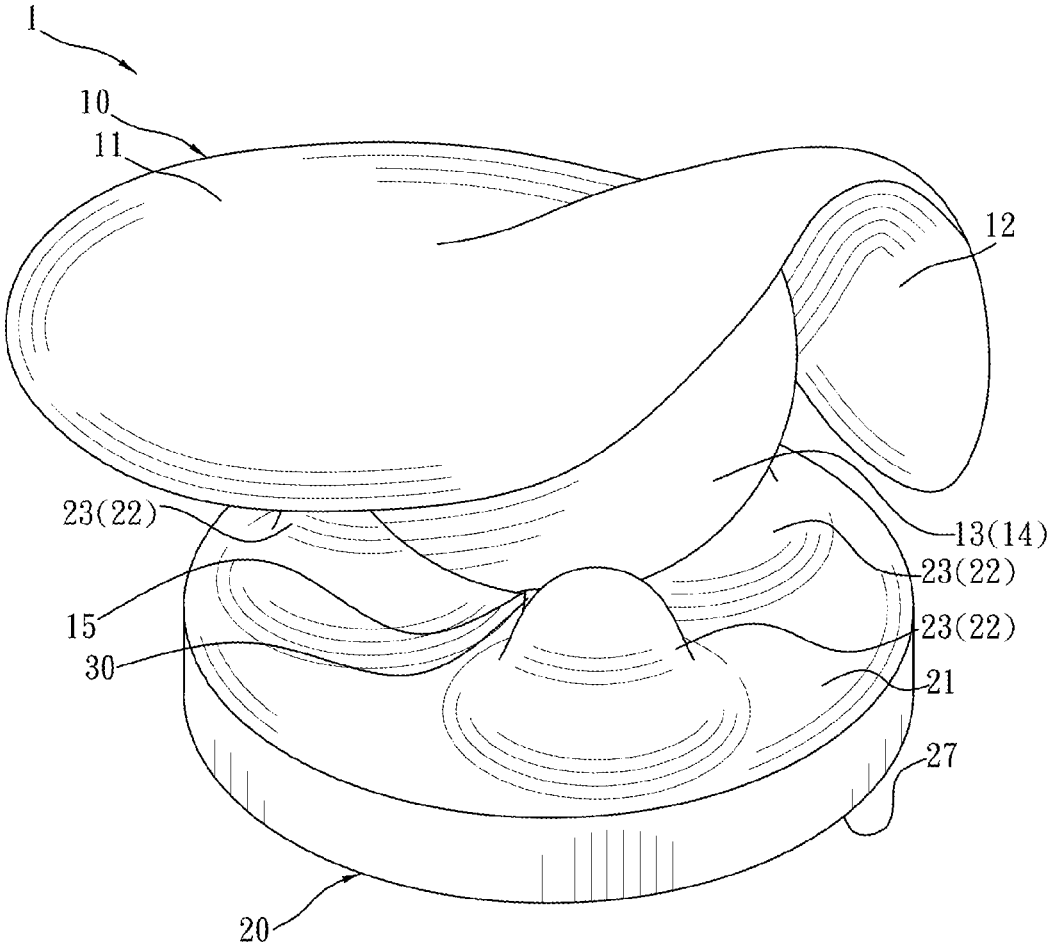
FIG. 1 is a perspective view of an embodiment according to the present invention.
Figure 4:
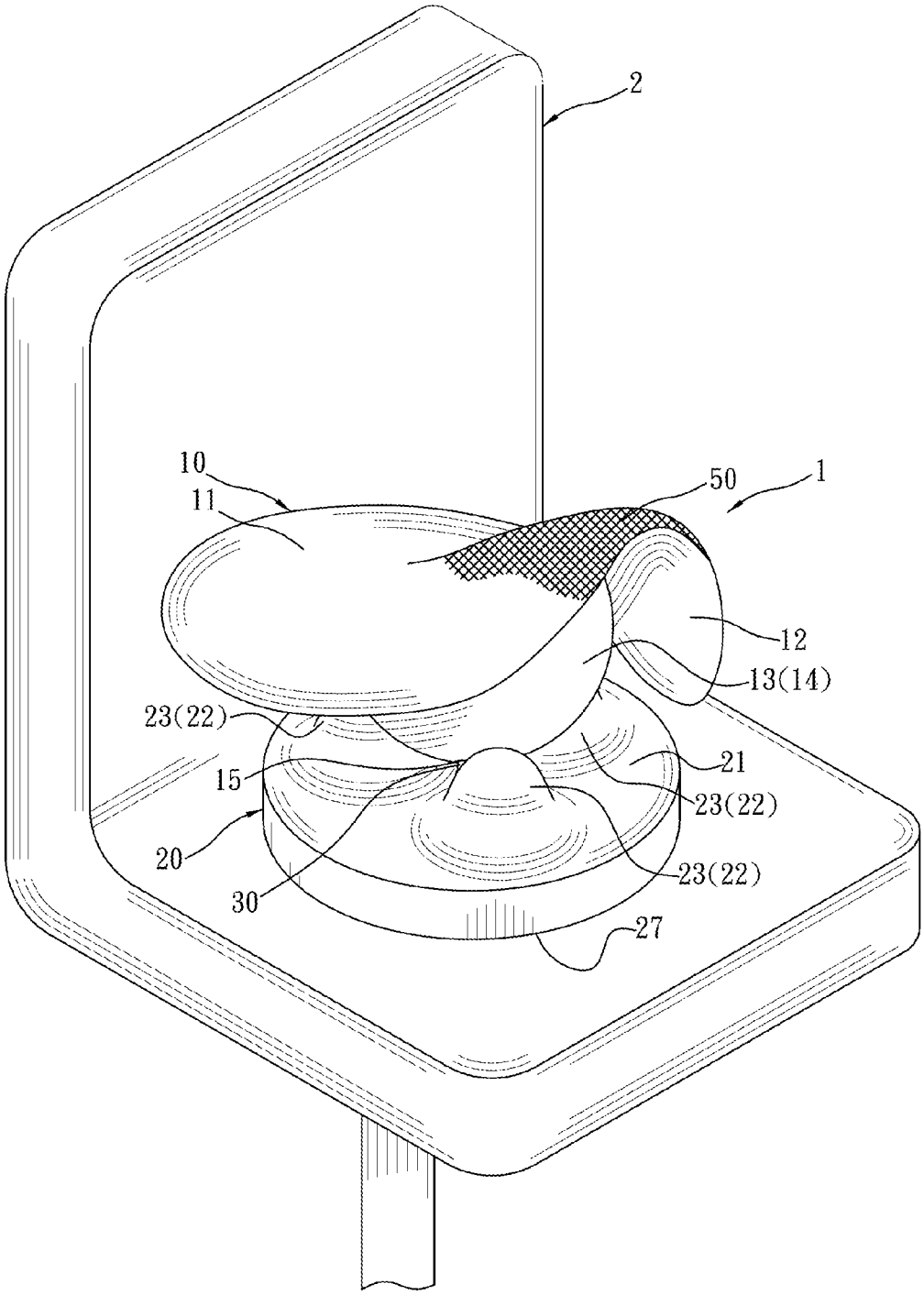
FIG. 4 is a schematic drawing showing the embodiment in FIG. 1 in use according to the present invention.

Refer to FIG. 1, a seat for hip shaking 1 of the present invention includes a seat member 10 and a base member 20. The seat member 10 consists of a saddle-shaped seat surface 11 for users to sit thereon, a bottom surface 12 opposite to the seat surface 11, and a spherical surface 13 projecting downward from the bottom surface 12. A soft member 50 such as pad or leather cover is disposed on the saddle-shaped seat surface 11 of the seat member 10 for users' comfort while they are sitting on the seat member 10, as shown in FIG. 4.

The base member 20 is arranged under the seat member 10 and at least one support part 22 is set on a top surface 21 thereof. A bottom surface 27 of the base member 20 is, but not limited to, a flat surface that is able to be set stably on a surface of a chair 2, as shown in FIG. 4. Thus the base member 20 will not slide relative to the chair 2 while in use.

Figure 5:
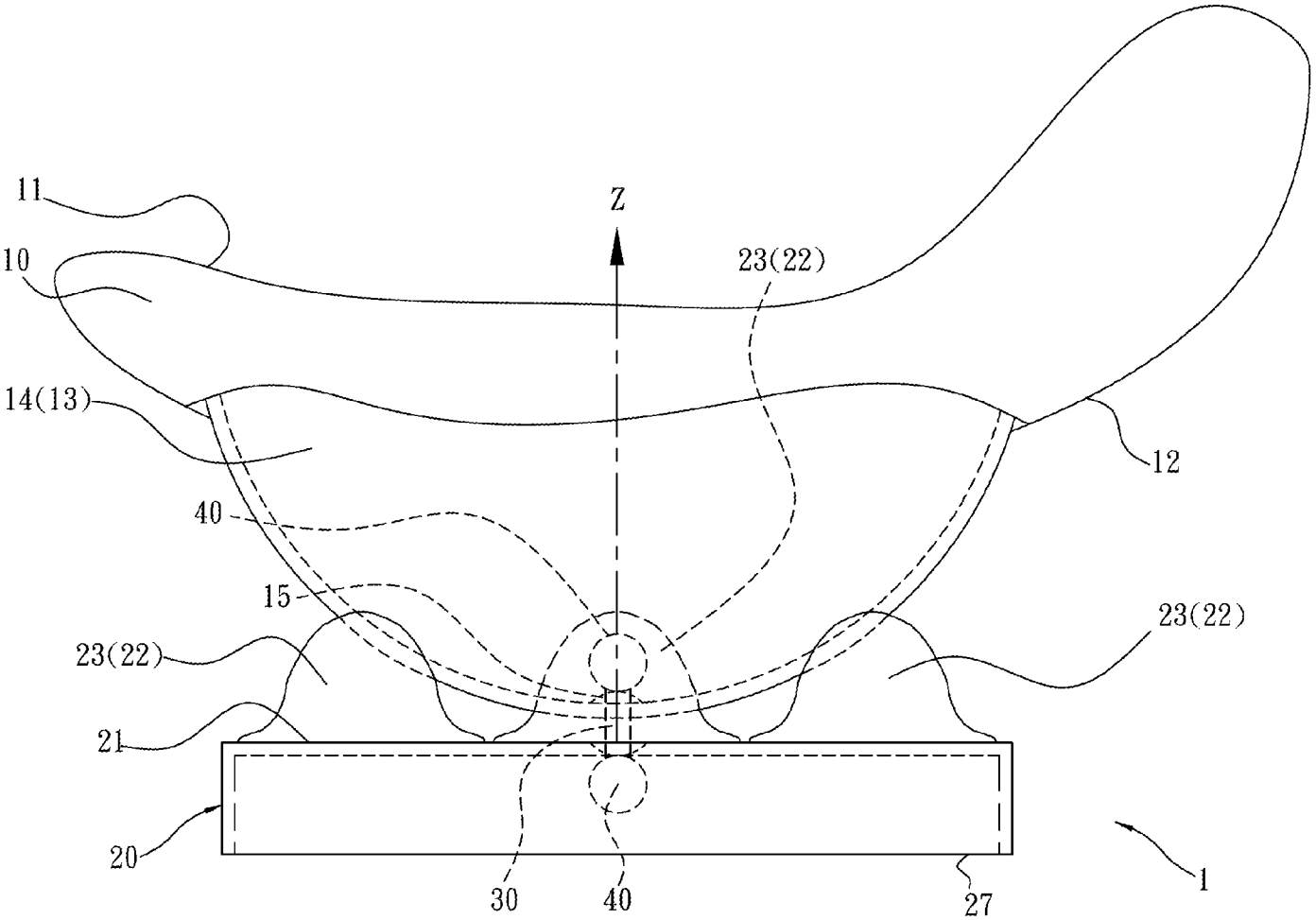
FIG. 5 is a schematic drawing showing a side view of the embodiment in FIG. 1 according to the present invention.
Figure 6:
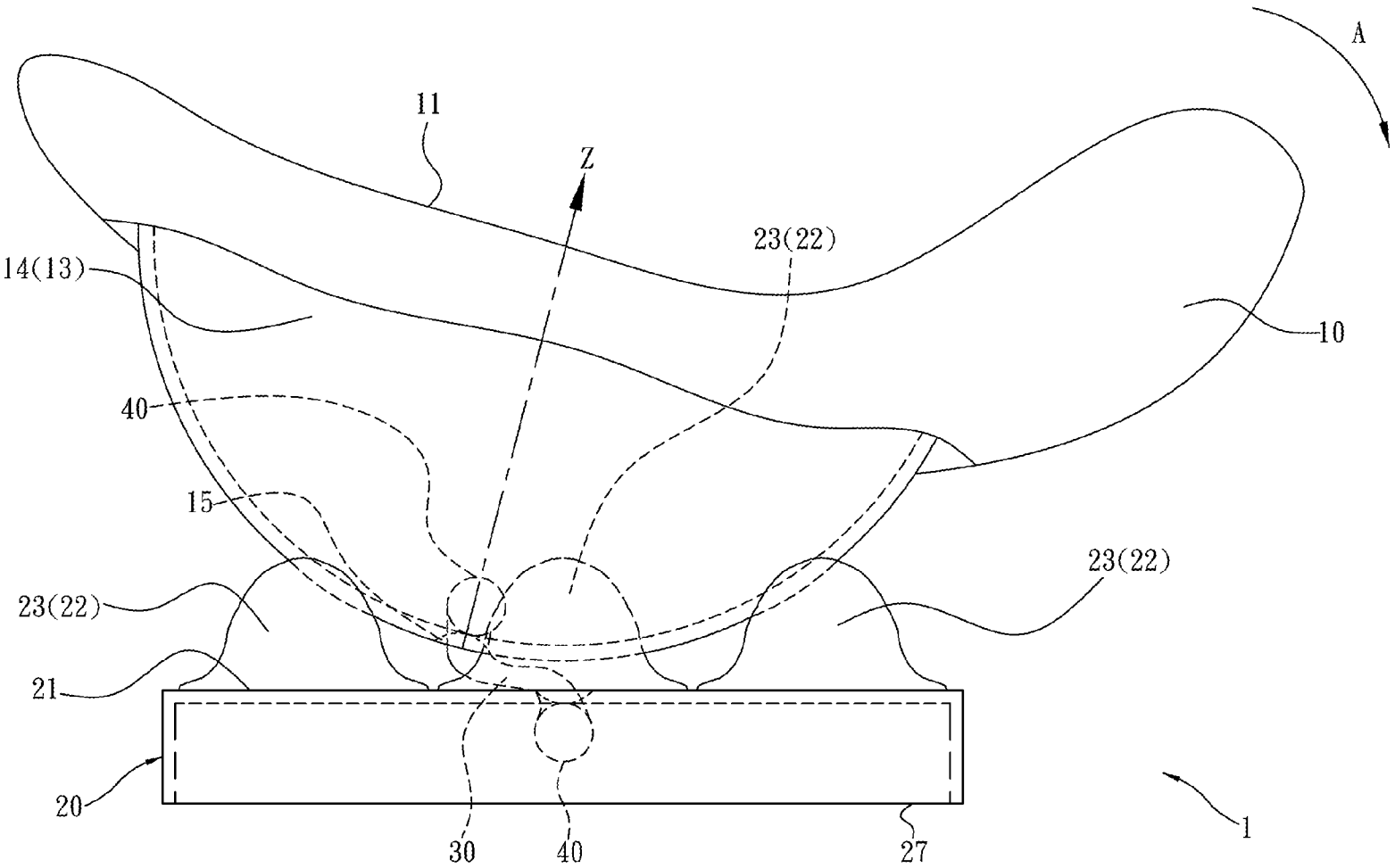
FIG. 6 is a schematic drawing showing a side view of the embodiment in FIG. 5 in movement according to the present invention.
Figure 9:
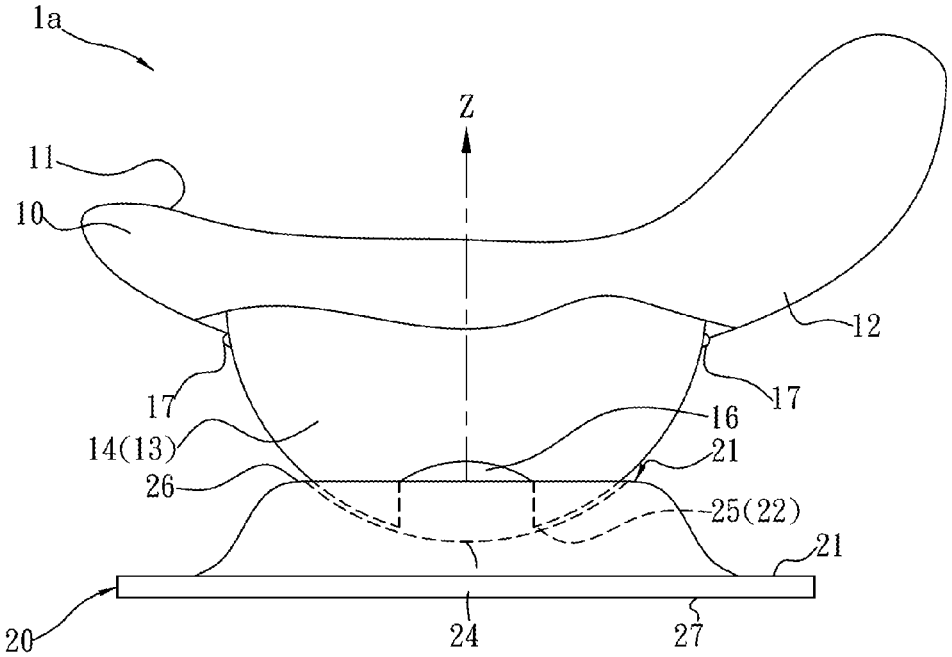
FIG. 9 is a schematic drawing showing a side view of the embodiment in FIG. 7 according to the present invention.
Figure 10:
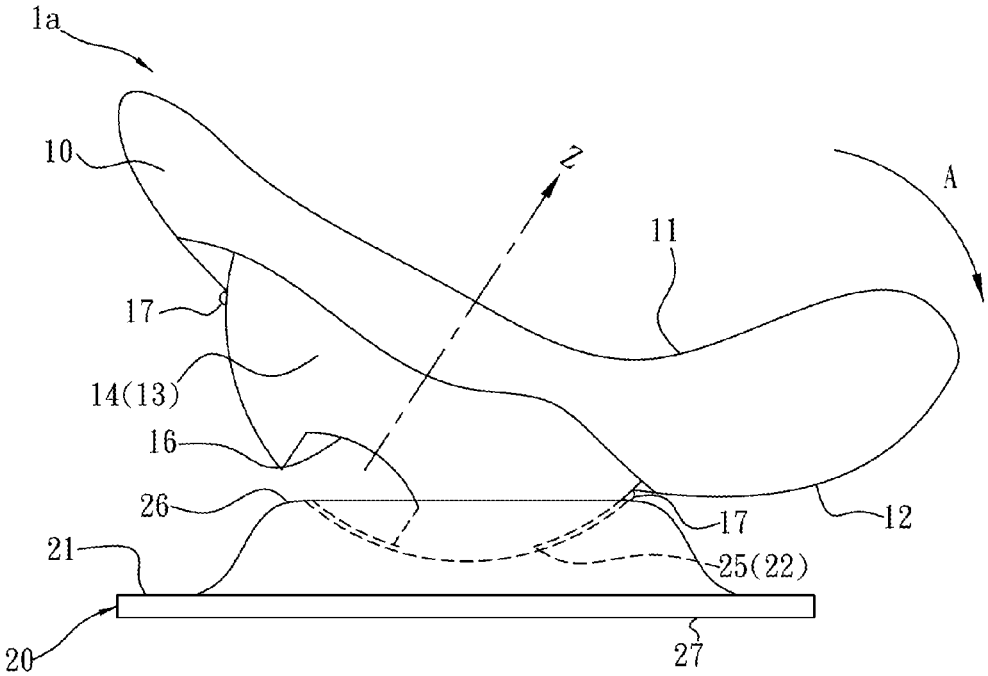
FIG. 10 is a schematic drawing showing a side view of the embodiment in FIG. 9 in movement according to the present invention.

The spherical surface 13 of the seat member 10 is moveably supported by the support part 22 of the base member 20. Thereby the seat member 10 is moved into the front, the back, the left, the right, or an arbitrary direction freely. Or the seat member 10 is rotated at an arbitrary angle. Refer to FIG. 5 and FIG. 9, a central axis Z of the spherical surface 13 is perpendicular to the base member 20. Then the seat member 10 is moved in an arbitrary direction, as the arrow A indicates in FIG. 6. The central axis Z of the spherical surface 13 is inclined relative to the base member 20, as shown in FIG. 6 and FIG. 10. The arrow A in FIG. 6/FIG. 10 represents only one direction that the central axis Z of the spherical surface 13 in FIG. 5 and FIG. 9 is tilted. The user sits on the saddle-shaped seat surface 11 can shake his/her hip toward to the front, the back, the left, the right or any direction he requires. For example, the user moved from the position shown in FIG. 5 and FIG. 9 to the position shown in FIG. 6 and FIG. 10. Moreover, the movement distance/magnitude is controlled by the user as long as the seat member 10 is not separated from the support 22 part of the base member 20.

When the user sits on the saddle-shaped seat surface 11 of the seat member 10, he/she can move toward a specific direction freely or move around relative to the base member 20. The user shakes his/her hips or maintains his/her balance so as to get the benefits of exercise like horse riding.

Refer from FIG. 1 to FIG. 6, in this embodiment, the spherical surface 13 of the seat member 10 of the seat for hip shaking 1 is a hemispherical surface 14. The support part 22 includes three hemispherical bumps 23 that are projecting from the top surface 21 of the base member 20, having the same height and disposed in a regular triangle shape. Thus the spherical surface 13 of the seat member 10 (the hemispherical surface 14) is moveably and stably supported by the three hemispherical bumps 23.

Figure 2:
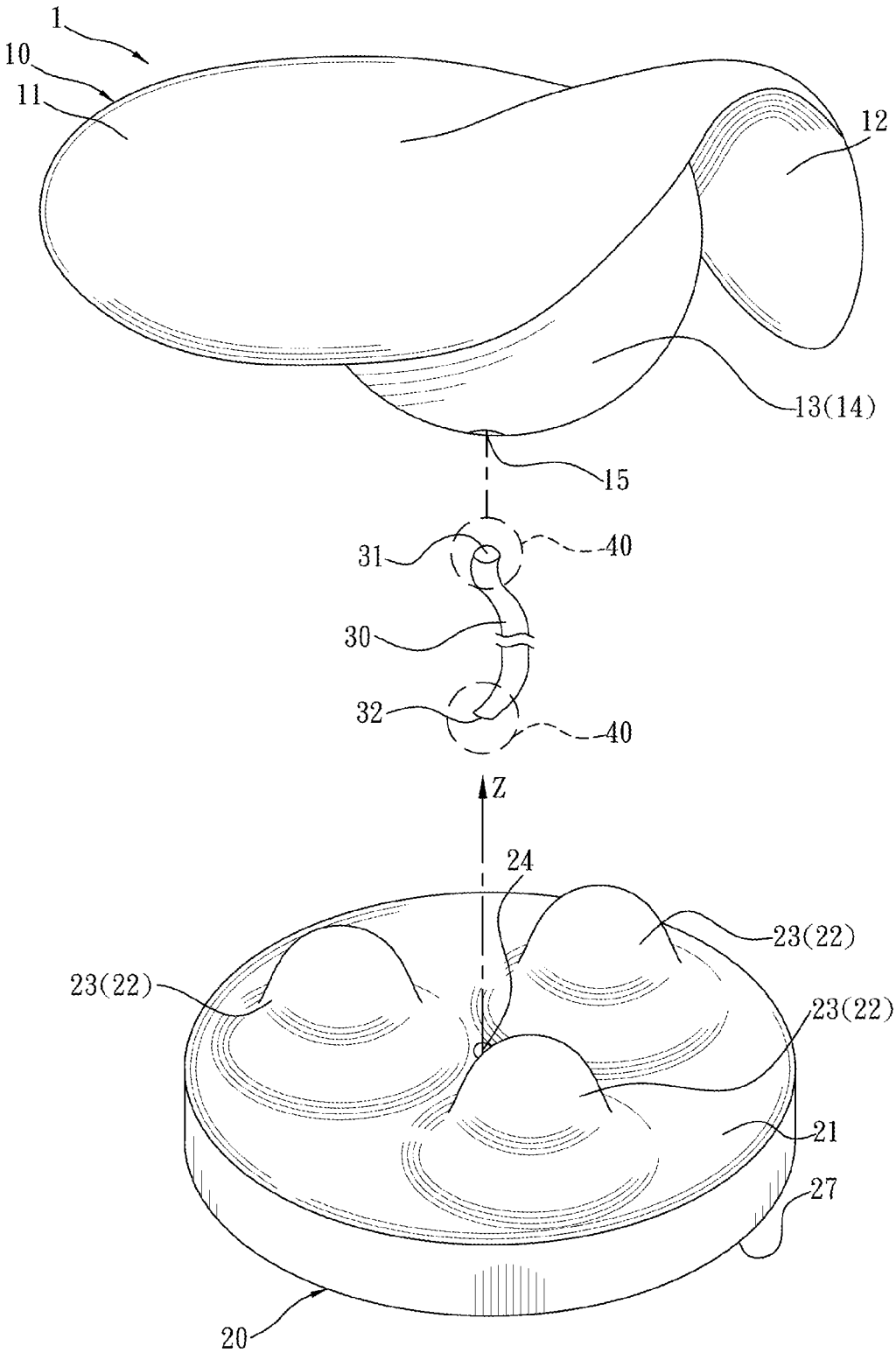
FIG. 2 is an explosive view of the embodiment in FIG. 1 according to the present invention.
Figure 3:
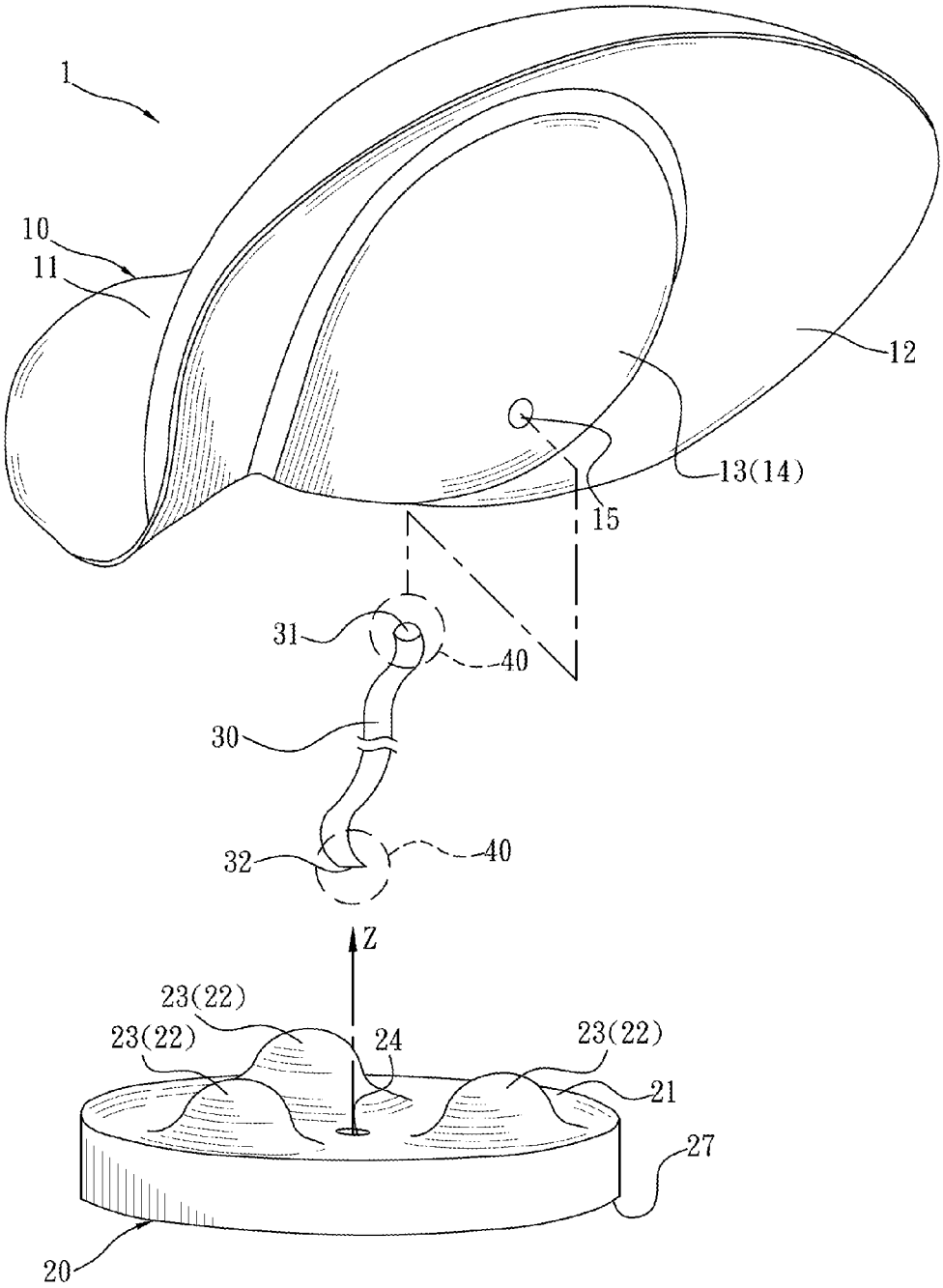
FIG. 3 is an explosive view of the embodiment in FIG. 2 viewed from another angle according to the present invention.

Refer to FIG. 2, FIG. 3 and FIG. 5, an elastic band 30 with flexibility, a certain length and stretchability (such as rubber band) is used to connect the seat member 10 and the base member 20. When an upper end 31 and a lower end 32 of the elastic band 30 are pulled by a force, extension of the length (elongation) of the elastic band 30 occurs, as shown in FIG. 6. Once the force applied disappears, the elastic band 30 turns back to the original state, as shown in FIG. 5. Thereby the seat member 10 will not fall off or separate from the base member 20 easily.

A through hole 15 is set on a center of the spherical surface 13 (the hemispherical surface 14) of the seat member 10 while a clearance hole 24 is arranged at a center of the three hemispherical bumps 23 of the base member 20. The upper end 31 and the lower end 32 of the elastic band 30 are passed through the through hole 15 and the clearance hole 24 respectively to be fixed. The way for fixing the upper end 31/lower end 32 is not limited, able to tie a knot or use a fastener 40, as shown in FIG. 6. By flexible and stretchable properties of the elastic band 30, the seat member 10 can be swung an angle within a certain range relative to the base member 20. For example, the user can shake his/her hip from the position shown in FIG. 5 to the position shown in FIG. 6 while sitting on the saddle-shaped seat surface 11 of the seat member 10 so as to get beneficial effects like horse-riding.

Refer from FIG. 7 to FIG. 10, another embodiment of seat for hip shaking 1*a* is revealed. The difference between this embodiment 1*a* and the above one (shown in FIG. 1 to FIG. 6) is in that the support part 22 of the base member 20 of this embodiment is a concave spherical surface 25 while the support part 22 of the base member 20 of the above embodiment are three spherical bumps 23. Thus the spherical surface 13 (the hemispherical surface 14) of the seat member 10 is moveably coupled to and sliding in the concave spherical surface 25 of the base member 20.

Furthermore, a recess 16 is arranged at a center of the bottom of the spherical surface 13 (the hemispherical surface 14) of the seat for hip shaking 1*a*. The shape of the recess 16 is not limited. The recess 16 is used for reduction of friction area and friction force generated during rotation of the spherical surface 13 (the hemispherical surface 14) of the seat member 10 in the concave spherical surface 25. The amount of material required for production of the seat member 10 is also decreased. Thus both weight and cost of the device are down.

Figure 7:
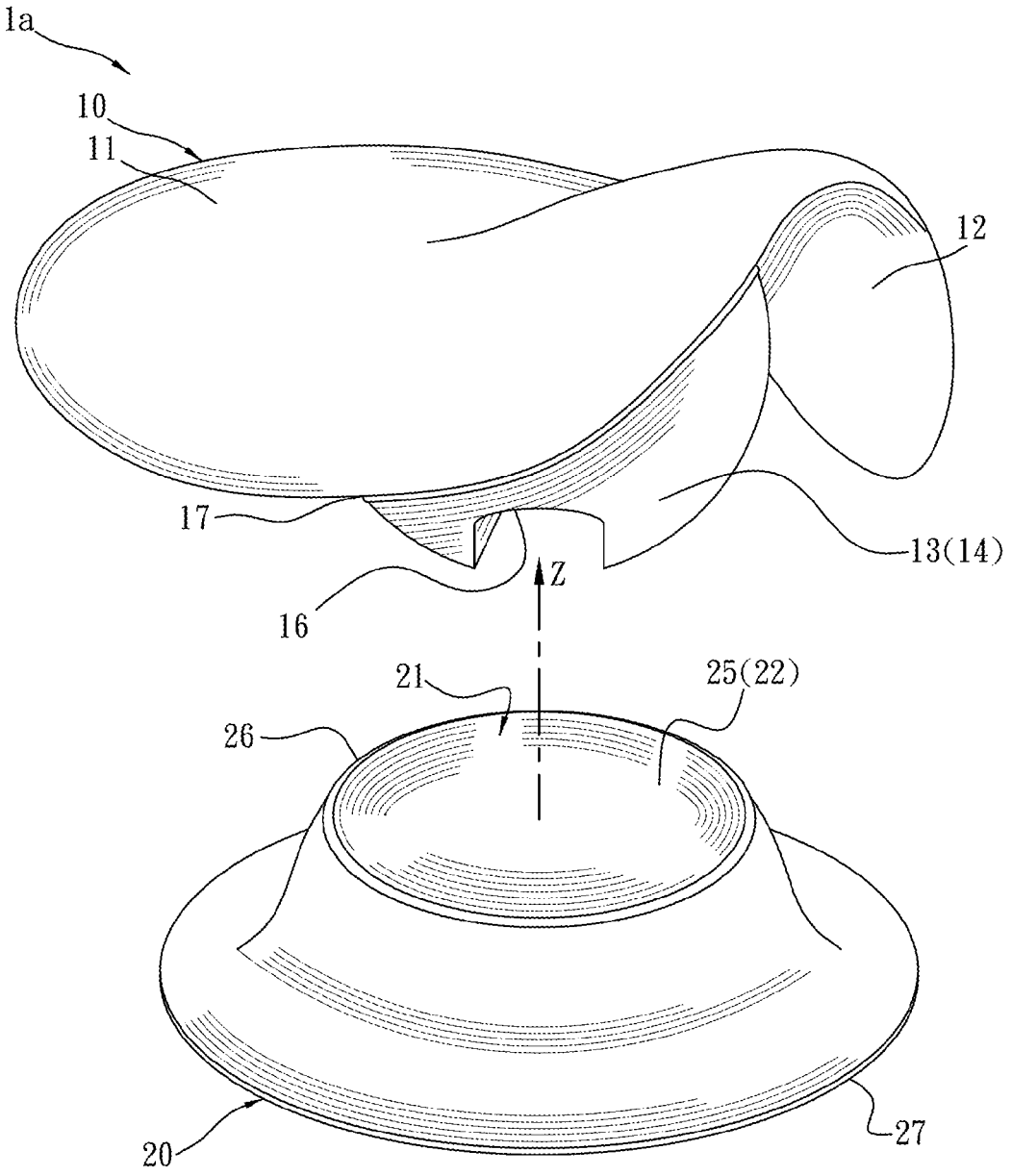
FIG. 7 is a perspective view of another embodiment according to the present invention.
Figure 8:
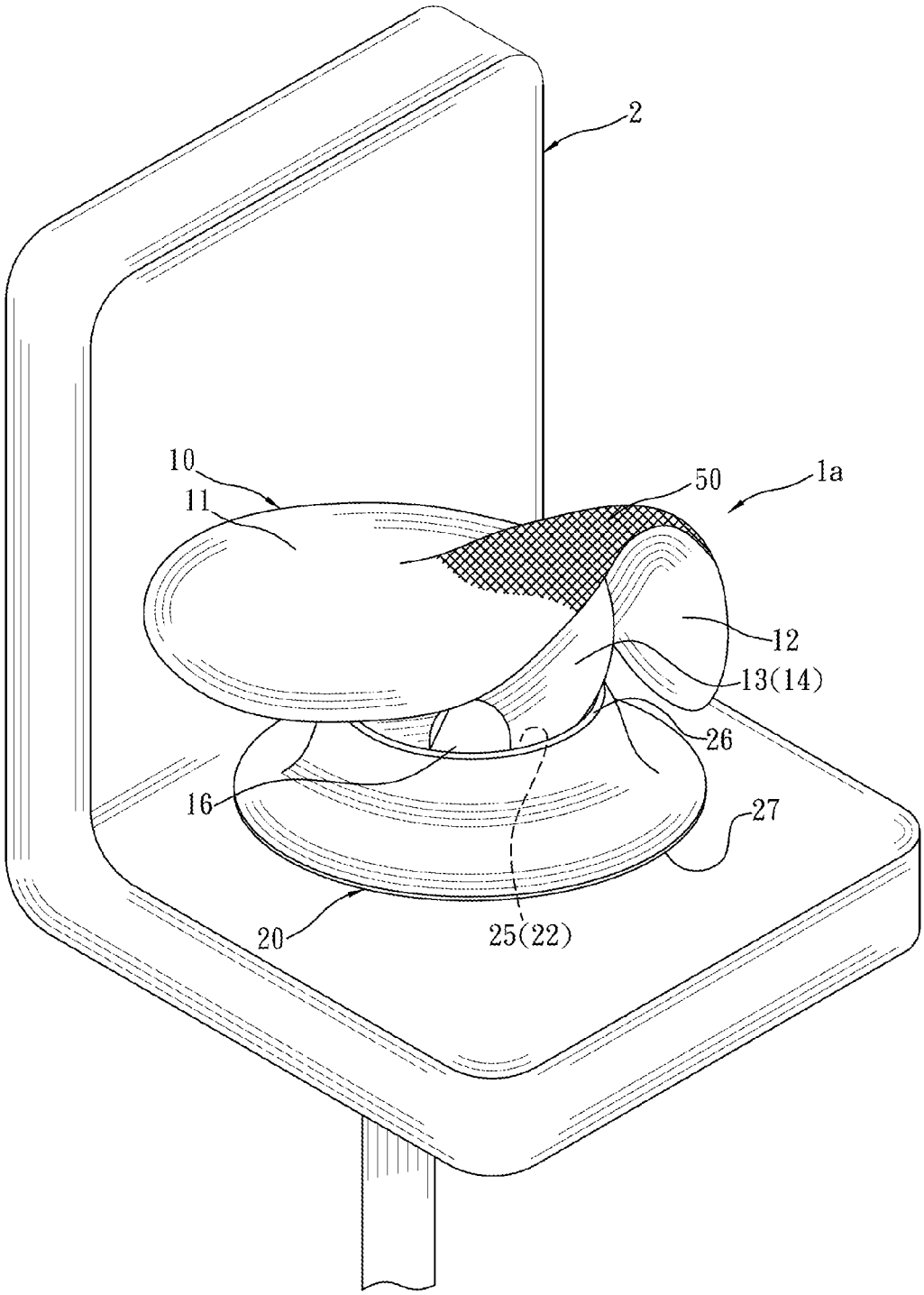
FIG. 8 is a schematic drawing showing the embodiment in FIG. 7 in use according to the present invention.

Refer to FIG. 7, FIG. 9 and FIG. 10, a circular stopper 17 is disposed on an upper edge of the spherical surface 13 (the hemispherical surface 14) for defining or limiting the maximum magnitude of the seat member 10 shaken in the concave spherical surface 25. Thus the seat member 10 is stopped on an upper edge 26 of the concave spherical surface 25 by the circular stopper 17 while being shaken vigorously in the concave spherical surface 25, without falling off or causing danger to the user Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A seat for hip shaking comprising:

a seat member having a saddle-shaped seat surface for users to sit, a bottom surface thereof located opposite to the saddle-shaped seat surface, and a spherical surface projecting downward from the bottom surface;

a base member that is arranged under the seat member and having at least one support part on a top surface thereof;

wherein the spherical surface of the seat member is moveably disposed over the support part of the base member so that the seat member is moved into an arbitrary direction or rotated at an arbitrary angle relative to the base member by the spherical surface supported by the support part; wherein users shake their hips or maintain their balance so as to get benefits of exercise like horse riding while sitting on the saddle-shaped seat surface of the seat member;

wherein the support part includes three hemispherical bumps that are projecting from the top surface of the base member, having the same height and arranged at a regular triangle shape;

the spherical surface of the seat member is moveably supported by the three hemispherical bumps.

2. The device as claimed in claim 1, wherein the spherical surface is a hemispherical surface.

3. The device as claimed in claim 2, wherein the seat for hip shaking further includes an elastic band with flexibility and stretchability, and used for connecting the seat member and the base member.

4. The device as claimed in claim 1, wherein the seat for hip shaking further includes an elastic band with flexibility and stretchability, and used for connecting the seat member and the base member.

5. The device as claimed it claim 3, wherein a through hole is set on a center of a bottom of the spherical surface of the seat member while a clearance hole is arranged at a center of the three hemispherical bumps of the base member; an upper end and a lower end of the elastic band are passed through the through hole and the clearance hole respectively to be fixed so that the seat member is able to be shaken an angle within a certain range relative to the base member by the elastic band.

6. The device as claimed in claim 4, wherein a through hole is set on a center of a bottom of the spherical surface of the seat member while a clearance hole is arranged at a center of the three hemispherical bumps of the base member; an upper end and a lower end of the elastic band are passed through the through hole and the clearance hole respectively to be fixed so that the seat member is able to be shaken an angle within a certain range relative to the base member by the elastic band.

7. The device as claimed in claim 5, wherein the upper end and the lower end of the elastic band are fixed by tying a knot or using a fastener after being passed through the through hole and the clearance hole respectively.

8. The device as claimed in claim 6, wherein the upper end and the lower end of the elastic band are fixed by tying a knot or using a fastener after being passed through the through hole and the clearance hole respectively.

9. The device as claimed in claim 1, wherein the support part of the base member is a concave spherical surface so that the spherical surface of the seat member is moveably coupled to and sliding in the concave spherical surface of the base member.

10. The device as claimed in claim 6, wherein a recess is arranged at a center of a bottom of the spherical surface of the seat member and a circular stopper is disposed on an upper edge of the spherical surface.

11. The device as claimed in claim 1, wherein a bottom surface of the base member is a flat surface being set on a surface of a chair while in use.

12. The device as claimed in claim 1, wherein a soft member is disposed on the saddle-shaped seat surface of the seat member.

* * * * *